United States Patent [19]

Stout et al.

[11] Patent Number: 4,675,132

[45] Date of Patent: Jun. 23, 1987

[54] POLYUNSATURATED FATTY ACIDS FROM FISH OILS

[75] Inventors: Virginia F. Stout; John Spinelli, both of Seattle, Wash.

[73] Assignee: The United States of America as represented by the Secretary of Commerce, Washington, D.C.

[21] Appl. No.: 879,543

[22] Filed: Jun. 24, 1986

Related U.S. Application Data

[63] Continuation of Ser. No. 716,913, Mar. 28, 1985, abandoned.

[51] Int. Cl.[4] ..... C11B 1/16

[52] U.S. Cl. ..... 260/412; 260/412.1; 260/412.8; 260/415; 260/421; 260/428.5; 260/410.9 R

[58] Field of Search ..... 260/410.9 R, 412.1, 260/412.8, 415, 421, 428.5, 412

[56] References Cited

U.S. PATENT DOCUMENTS 3,755,385 8/1973 Hutchins ..... 260/428.5

OTHER PUBLICATIONS

Eisenbach, *Ber. Bunsenges. Phys. Chem.,* 88, 1984, pp. 882–887.

West Coast Fisheries Development Foundation, *Pacific Seafood Chronicle,* pp. 1 and 2.

Glauglitz et al., *The Journal of the American Oil Chemists' Society,* vol. 40, No. 5, 1963, pp. 197–198.

*Primary Examiner*—Charles F. Warren
*Assistant Examiner*—Elizabeth A. Flaherty
*Attorney, Agent, or Firm*—Eugene J. Pawlikowski; Alvin J. Englert; Albert Tockman

[57] ABSTRACT

Polyunsaturated fatty acid moieties in fish oil are concentrated by transesterifying fish oil glycerides with a lower alkanol to form a mixture of lower alkyl fatty acid esters, and extracting the esters with carbon dioxide under supercritical conditions.

19 Claims, 1 Drawing Figure

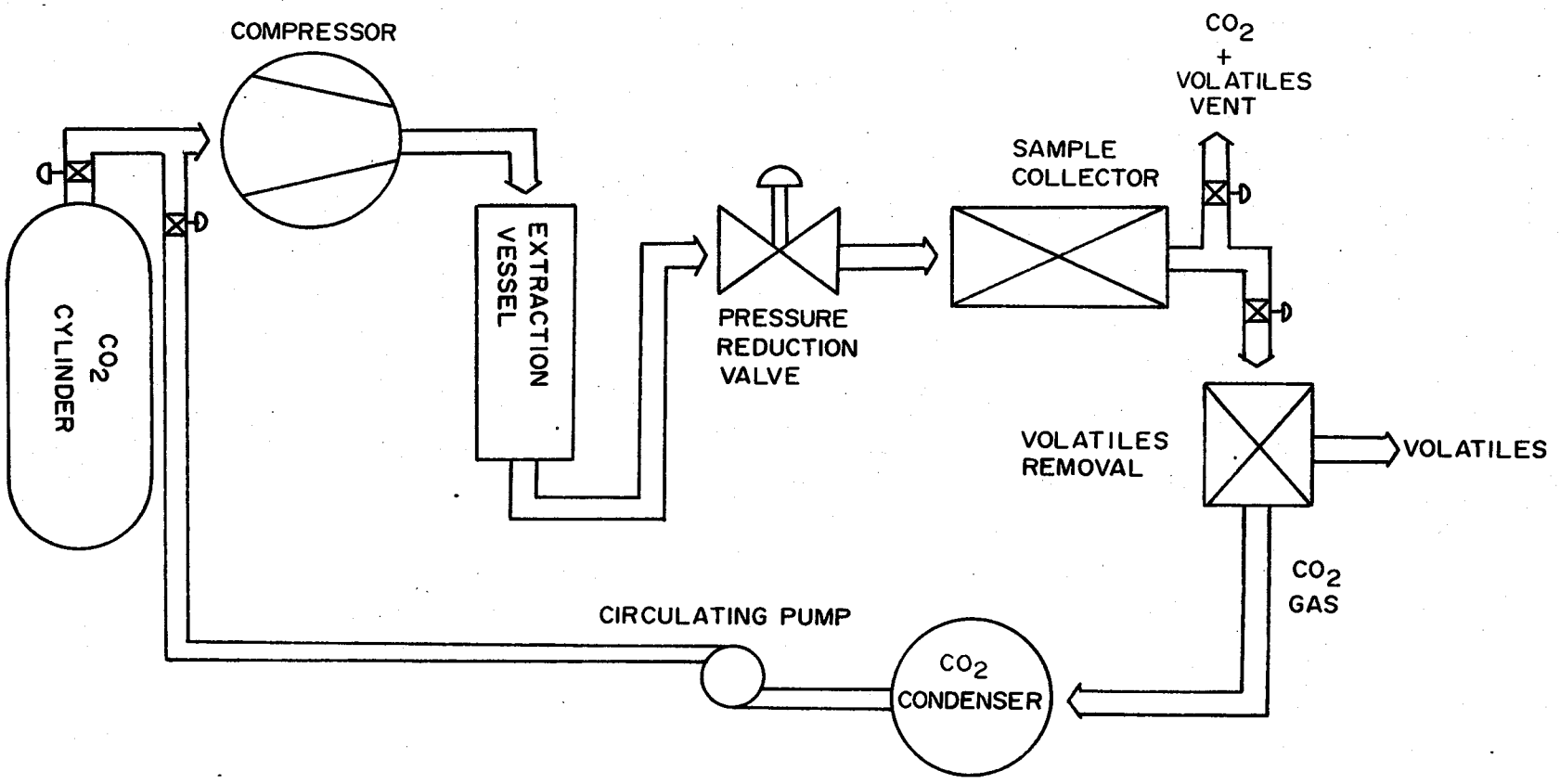
VOLATILES
$CO_2$ + VOLATILES VENT
$CO_2$ GAS
SAMPLE COLLECTOR
VOLATILES REMOVAL
$CO_2$ CONDENSER
PRESSURE REDUCTION VALVE
CIRCULATING PUMP
EXTRACTION VESSEL
COMPRESSOR
$CO_2$ CYLINDER

POLYUNSATURATED FATTY ACIDS FROM FISH OILS

This application is a continuation of application Ser. No. 716,913, filed Mar. 26, 1985, now abandoned.

BACKGROUND OF THE INVENTION

The present invention relates to a process for the concentration of polyunsaturated fatty acids present in fish oils.

Fish oils contain a complex mixture of fatty acid moieties, mostly straight chain with even numbers of carbon atoms. These moieties, mainly present as their glycerides, are either saturated or mono- or polyunsaturated. Whereas vegetable oils and fats from terrestrial animals are composed mainly of fatty acids containing a maximum of 18 carbons and two or three double bonds, fish and marine mammal oils are composed of substantial amounts of fatty acid moieties containing 20 or 22 carbons and four, five or six double bonds, Stansby, "Fish Oils" Avi Publishing Company, Inc. (1967). Among the fatty acid moieties unique to fish oils are the following n-3 compounds: 18:4, 20:4, 20:5, 22:4, 22:5, 22:6. As generally used, n-3 or omega-3 means that the first double bond begins at the third carbon counting from the methyl end of the chain. In the number:number designation, the first number indicates chain length and the second number indicates how many double bonds are present. For example, 18:4 indicates a straight chain comprised of 18 carbon atoms containing 4 methylene-interrupted double bonds.

The polyunsaturated components of fish and marine mammal oils are of particular interest because they differ significantly from those found in vegetable oils or fats from terrestrial animals. Highly unsaturated fatty acids, such as those contained in fish oils, are important dietary factors beneficial in reducing the development of atherosclerotic lesions, Dyerberg et al, "Nutritional Evaluation of Long-chain Fatty Acids in Fish Oil", pp 245–261, Academic Press, London (1982). Accordingly, there is great interest in obtaining the polyunsaturated fatty acids present in fish oils in a more concentrated form.

The separation of fatty acids is complicated by several factors. First, due to their high molecular weights, the differences in their molecular weights are relatively small making it difficult to separate them by conventional means. This is particularly the case when saturated and unsaturated fatty acids of the same chain length are to be separated. Second, polyunsaturated compounds are readily susceptible to polymerization, degradation and/or oxidation, even at moderately elevated temperatures.

Fatty acid moieties are most conveniently separated as their lower alkyl esters. Current methods for fractionating fish oil esters use urea complexing, which selectively removes mono-unsaturates such as 20:1 and 22:1, and/or adsorption and/or absorption chromatography, and/or fractional and/or molecular distillation, processes which are cumbersome and time consuming. Particularly undesirable are methods which require the use of difficult-to-remove organic solvents, and thus leave toxic residues in the fractionated esters. Methods involving heating at temperatures approaching 200° C. introduce the possibility of alteration and the formation of toxic substances.

A recently reported method for separating various fatty acid components in cod fish oil uses a combination of extraction with supercritical carbon dioxide and fractionation, Eisenbach, *Ber. Bunsenges. Phys. Chem.*, 88 882–887 (1984). The fractionation column contains stainless steel packings to provide an opportunity for equilibration between the individual fish oil esters and carbon dioxide. Fractionation is enhanced by a hot finger fitted into the top of the fractionation column. Heat reduces the density of the carbon dioxide/fish oil ester solution, and concommitantly decreases the solubility of all solutes, but not to the same extent. The more soluble components are removed and the less soluble components are returned and concentrate in the reactor vessel. Those less soluble components can be recovered from the reactor or alternatively can be extracted and removed through the fractionation column by reducing the temperature of the hot finger. Such a process, which involves fractionation, is rather time consuming and exposes the fatty materials being separated to thermal degradation.

An article in the December 1983–January 1984 issue of the Pacific Seafood Chronicle, West Coast Fisheries Development Foundation, discusses extraction of various materials with supercritical carbon dioxide. The article indicates, without giving details, that such extraction might also be used to separate highly unsaturated fatty acids from the more saturated acids present in fish oils.

SUMMARY OF THE INVENTION

It is an object of the present invention to provide an improved process for the concentration of polyunsaturated fatty acid moieties present in fish oils.

Upon further study of the specification and appended claims, further objects and advantages of this invention will become apparent to those skilled in the art.

In accordance with these objectives, the present invention is a process for the concentration of polyunsaturated fatty acid moieties in a fish oil containing relatively low proportions of saturated and mono-unsaturated fatty acid moieties of the same chain length as the polyunsaturated fatty acid moieties to be concentrated, which comprises transesterifying fish oil glycerides with a lower alkanol to form a mixture of lower alkyl fatty acid esters, and extracting said esters with carbon dioxide under supercritical conditions.

BRIEF DESCRIPTION OF THE DRAWING

The FIGURE in the drawing is a flow diagram illustrating the process of the present invention.

DETAILED DESCRIPTION

Supercritical carbon dioxide, which is carbon dioxide above its critical temperature of 31° C. and which cannot be liquified by increasing its pressure, is known to have selective solvent properties for the preparation of human food-grade products. Carbon dioxide is non-toxic, non-flammable, readily available and relatively inexpensive. Extraction with carbon dioxide is effected at moderately elevated temperatures, which limits autoxidation, decomposition and/or polymerization of the highly unsaturated moieties present in fish oil esters. Furthermore, the inert atmosphere of carbon dioxide excludes oxygen, the cause of autoxidation.

Supercritical carbon dioxide has been found to be a superior solvent for concentrating lower alkyl polyunsaturated fatty acid esters prepared from certain fish oils. Extraction with carbon dioxide at pressures of 2000–3500 pounds per square inch (psi) and temperatures of 24°–80° C. causes the fish oil esters to separate, mostly according to chain length, but also somewhat according to the degree and kind of unsaturation present. At higher temperatures, supercritical carbon dioxide becomes less dense and solubility of the esters is decreased; the shorter chain components become more soluble than the longer chain ones, thereby enhancing the selectivity of the process.

Since supercritical carbon dioxide fractionates fish oil components mainly by molecular weight, it distinguishes more readily between 18:1, 20:1 and 22:1 than it does betwen 20:0, 20:1, 20:4 and 20:5. For this reason, the choice of starting fish oil will affect the degree of concentration obtained. To concentrate the desired polyunsaturated fatty acid compounds, the starting fish oil should be as free as possible from undesirable fatty acids with the same number of carbons. For example, to obtain concentrates of 20:5 and 22:6, 20:1 and 22:1 should be present only in small amounts. Preferably neither 20:1 or 22:1 should be present in an amount exceeding 3% by weight of the fish oil.

Whereas many fish oils contain small amounts of the named n-3 compounds, and some marine oils contain higher proportions of those n-3 compounds, only a few species of marine fishes contain oil which is especially appropriate for the concentration of the components which are unique to fish oils. Oils from these few fish species contain relatively high proportions of the desired n-3 acid, and also contain relatively low proportions of the same chain length fatty acid moieties, which would interfere with the isolation of the desired n-3 compounds.

Superior fish oils for practicing the process of the present invention are menhaden oils (*Brevoortia tyrannus* and *Brevoortia patronus*) with high iodine values, as well as body oils from Peruvian sardine (*Clupea pilchardus*), sea bass (*Lateolabrax japonicus*), albacore tuna (*Thunnus germo*), skipjack tuna (*Katsuwonus pelamis*), yellowfin tuna (*Neothunnus macropterus*), and any other marine organism containing low proportions of 20:0, 20:1, 22:0 and/or 22:1 fatty acid moieties as well as high concentrations of the desired n-3 polyunsaturated fatty acid moieties. Unsuitable fish oils for this purpose because they contain relatively high proportions of 20:1 and 22:1 are cod liver, capelin, dogfish liver, herring and sardine oils. Codfish oil, for example, contains 11.4% of 20:1 and 8.6% of 22:1.

In practicing the present invention, fish oil glycerides are transesterified with an alkali metal and a lower alkanol containing 1 to 6 carbon atoms, such as methanol, ethanol, propanol, isopropanol, butanol, sec-butyl alcohol, iso-pentyl alcohol, n-hexanol and the like, Gauglitz et al, *J. Am. Oil Chem. Soc.*, 40, 197–198 (1963). The combination sodium and methanol is preferred.

The fatty acids as such, corresponding to the esters being concentrated according to the process of the present invention, can be concentrated in an analogous manner. First, the glycerides containing the fatty acids are hydrolyzed or saponified in a conventional manner, but avoiding conditions which would degrade the polyunsaturated acid moieties present. The free acids, after neutralization of the glycerides and saponification with alkali, are extracted with carbon dioxide under supercritical conditions, the same as their esters.

Prior to extraction with carbon dioxide, the fatty acid containing entity can be pretreated to remove naturally-occuring impurities such as phospholipids, vitamins, etc., lower boiling materials and/or mono-unsaturated moieties.

The process of our invention is further illustated by reference to the drawing.

The mixture of fish oil esters is charged into the extraction vessel. Oxygen is flushed from the system by repeatedly pressurizing to 150 psi with carbon dioxide from the carbon dioxide cylinder and exhausting gas from the system. The extraction vessel and preheater (not shown, located between the compressor and the extraction vessel) are then heated to the desired temperature, taking care to avoid overheating and decomposing the fish oil esters. At the same time, the pressure in the system is increased to the desired pressure using the compressor to compress carbon dioxide from the carbon dioxide cylinder.

When the predetermined temperature and pressure are attained, flow of carbon dioxide is begun by opening the pressure reduction valve. Solid carbon dioxide and fish oil esters collect in the sample collector, which is cooled in a dry ice/acetone bath to prevent loss of esters. Excess carbon dioxide can be vented; if the carbon dioxide is to be recycled, volatile components are removed prior to recycle. After collection of the first fraction is complete, the pressure reduction valve is closed and a second collector is installed to allow collection of further material. Similarly, several fractions are collected until all the components capable of extraction have passed out of the extraction vessel into the sample collectors. The solid carbon dioxide is thawed and the fish oil esters are recovered in each fraction. The first fraction contains the components which are most soluble in the supercritical carbon dioxide; successive fractions contain components of lesser solubility.

Since lower molecular weight components are more soluble than those with higher molecular weights, esters of fatty acids containing up to 18 carbon atoms concentrate in the earlier fractions and those with 20 and 22 carbon atoms in subsequent fractions. It is possible to obtain fractions containing as much as 57–64% docosahexaenoic acid ester and/or 19%-23% eicosapentaenoic acid ester starting with fish oil esters containing only 8–10% of those acids.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLE 1

Methyl esters were prepared by transesterification (alcoholysis) of light cold-pressed menhaden oil with anhydrous methanol and sodium. The esters were purified by molecular distillation, Gauglitz, Jr., and Gruger, Jr., *J. Am. Oil Chem. Soc.*, 42, 561–563 (1965), prior to extraction with carbon dioxide.

Using the apparatus and process described above, 6.99 g of mixed methyl esters from menhaden oil were charged into the extraction vessel. After oxygen was removed by purging with carbon dioxide, the vessel was heated to 74°–75° C. and pressurized to 2500 psi. The pressure reduction valve was opened, and carbon dioxide and esters began to pass into the sample collector, cooled in a dry ice-acetone bath. Six fractions of 10 liters carbon dioxide each were collected with the last fraction containing 19.7% of 20:5 and 48.3% of 22:6. The composition of important fatty acids found in the starting oil and in the fractions collected are summarized in the table which follows (18:4 and 20:1 are difficult to analyze separately and are reported together as 18:4/20:1).

| Fraction no. | Yield g | Yield % | 14:0 | 16:0 | 16:1 | 18:0 | 18;1 | 18:4/ 20:1 | 20:5 | 22:5 | 22:6 |
|---|---|---|---|---|---|---|---|---|---|---|---|
| | | | Fatty acid composition of fraction) | | | | | | | | |
| Starting oil | 6.99 | | 5.2 | 16.1 | 9.3 | 4.2 | 11.7 | 4.3 | 14.2 | 2.4 | 18.4 |
| 1 | 1.70 | 24.3 | 12.4 | 24.0 | 15.0 | 4.4 | 11.1 | 4.5 | 8.1 | — | 5.8 |
| 2 | 1.60 | 22.9 | 6.3 | 23.7 | 13.3 | 4.8 | 13.1 | 4.8 | 9.5 | 0.9 | 6.7 |
| 3 | 1.53 | 21.9 | 1.7 | 15.5 | 8.2 | 5.4 | 15.4 | 6.1 | 16.6 | 0.9 | 13.1 |
| 4 | 1.04 | 14.9 | 0.2 | 4.5 | 2.2 | 4.2 | 11.6 | 4.2 | 22.8 | 3.7 | 27.2 |
| 5 | 0.55 | 7.9 | — | — | — | 1.0 | 2.1 | 0.8 | 16.3 | 8.0 | 57.2 |
| 6 | 0.16 | 2.3 | | | | | | | | | |
| Σ | 6.58 | 94.1 | | | | | | | | | |
| | | | Mass Balance (g) | | | | | | | | |
| Starting oil | 6.99 | | 0.36 | 1.13 | 0.65 | 0.29 | 0.82 | | 0.99 | 0.17 | 1.28 |
| 1 | | | 0.21 | 0.41 | 0.26 | 0.07 | 0.19 | 0.08 | 0.14 | — | 0.10 |
| 2 | | | 0.10 | 0.38 | 0.21 | 0.08 | 0.21 | 0.08 | 0.15 | 0.01 | 0.11 |
| 3 | | | 0.03 | 0.24 | 0.13 | 0.08 | 0.24 | 0.09 | 0.25 | 0.01 | 0.20 |
| 4 | | | 0.00 | 0.05 | 0.02 | 0.04 | 0.12 | 0.04 | 0.24 | 0.04 | 0.28 |
| 5 | | | | | | 0.01 | 0.01 | 0.00 | 0.09 | 0.04 | 0.32 |
| Σ 1-5 | 6.42 | 91.9 | 0.34 | 1.08 | 0.62 | 0.28 | 0.77 | 0.29 | 0.87 | 0.10 | 1.01 |
| (%) | | | (94) | (96) | (95) | (97) | (94) | | (88) | (59) | (79) |

As shown above, supercritical carbon dioxide fractionation provides a practical means for separating the polyunsaturated components of fish oil from the saturated and mono-unsaturated ones that constitute the major part of fish oils. While less selective than that of Eisenbach, the present process is simpler, quicker and more economical. Lowering process time is particularly important, since the time element is critical in the treatment of fish oils, which are readily susceptible to thermal and oxidative degradation. Moreover, the very components being concentrated are those more susceptible to degradation.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

EXAMPLE 2

Methyl esters from menhaden oil (6.98 g) were separated as described in the previous example. Five fractions of 100 liters carbon dioxide each were collected. Fraction 3 contained 15.3% 20:5 and 63.9% 22:6, fractions 4 and 5 were not analyzed. The results of the run are summarized in the table below:

| Fraction no. | Yield g | Yield % | 14:0 | 16:0 | 16;1 | 18:0 | 18:1 | 18:4/ 20:1 | 20:5 | 22:5 | 22:6 |
|---|---|---|---|---|---|---|---|---|---|---|---|
| | | | Fatty acid composition (% of fraction) | | | | | | | | |
| Starting oil | 6.98 | | 5.2 | 16.1 | 9.3 | 4.2 | 11.7 | 4.3 | 14.2 | 2.4 | 18.4 |
| 1 | 2.39 | 34 | 9.2 | 25.0 | 14.3 | 4.4 | 11.7 | 4.7 | 9.3 | — | 6.4 |
| 2 | 2.08 | 30 | 1.4 | 11.0 | 6.4 | 4.5 | 13.5 | 2.3 | 18.9 | 2.7 | 20.2 |
| 3 | 0.58 | 8 | — | 0.4 | 0.2 | 0.7 | 2.3 | 0.2 | 15.3 | 5.7 | 63.9 |

EXAMPLE 3

This experiment proceeded as before starting with 6.99 g methyl esters. Six fractions of 100 liters carbon dioxide each were collected. Fraction 5 contained 16.3% of 20:5 and 57.2% of 22:6. The fatty acid composition and mass balance of the starting esters and of the fractions collected are given in the table below. Note that recovery of 20:5 is 88% and of 22:6 is 79%, excellent recoveries for highly unsaturated components that are readily degraded.

| Fraction no. | Yield g | Yield % | 14:0 | 16:0 | 16:1 | 18:0 | 18;1 | 18:4/ 20:1 | 20:5 | 22:5 | 22:6 |
|---|---|---|---|---|---|---|---|---|---|---|---|
| | | | Fatty acid composition of fraction) | | | | | | | | |
| Starting oil | 6.99 | | 5.2 | 16.1 | 9.3 | 4.2 | 11.7 | 4.3 | 14.2 | 2.4 | 18.4 |
| 1 | 1.70 | 24.3 | 12.4 | 24.0 | 15.0 | 4.4 | 11.1 | 4.5 | 8.1 | — | 5.8 |
| 2 | 1.60 | 22.9 | 6.3 | 23.7 | 13.3 | 4.8 | 13.1 | 4.8 | 9.5 | 0.9 | 6.7 |
| 3 | 1.53 | 21.9 | 1.7 | 15.5 | 8.2 | 5.4 | 15.4 | 6.1 | 16.6 | 0.9 | 13.1 |
| 4 | 1.04 | 14.9 | 0.2 | 4.5 | 2.2 | 4.2 | 11.6 | 4.2 | 22.8 | 3.7 | 27.2 |
| 5 | 0.55 | 7.9 | — | — | — | 1.0 | 2.1 | 0.8 | 16.3 | 8.0 | 57.2 |
| 6 | 0.16 | 2.3 | | | | | | | | | |
| Σ | 6.58 | 94.1 | | | | | | | | | |
| | | | Mass Balance (g) | | | | | | | | |
| Starting oil | 6.99 | | 0.36 | 1.13 | 0.65 | 0.29 | 0.82 | | 0.99 | 0.17 | 1.28 |
| 1 | | | 0.21 | 0.41 | 0.26 | 0.07 | 0.19 | 0.08 | 0.14 | — | 0.10 |
| 2 | | | 0.10 | 0.38 | 0.21 | 0.08 | 0.21 | 0.08 | 0.15 | 0.01 | 0.11 |
| 3 | | | 0.03 | 0.24 | 0.13 | 0.08 | 0.24 | 0.09 | 0.25 | 0.01 | 0.20 |
| 4 | | | 0.00 | 0.05 | 0.02 | 0.04 | 0.12 | 0.04 | 0.24 | 0.04 | 0.28 |
| 5 | | | | | | 0.01 | 0.01 | 0.00 | 0.09 | 0.04 | 0.32 |
| Σ 1-5 | 6.42 | 91.9 | 0.34 | 1.08 | 0.62 | 0.28 | 0.77 | 0.29 | 0.87 | 0.10 | 1.01 |
| (%) | | | (94) | (96) | (95) | (97) | (94) | | (88) | (59) | (79) |

What is claimed is:

1. A process for the concentration of polyunsaturated acids present as their glycerides in a fish oil containing relatively low proportions of saturated and monounsaturated fatty acids, also present as their glycerides, of the same chain length as the polyunsaturated fatty acids to be concentrated, consisting essentially of transesterifying said glycerides with a lower alkanol to form a mixture of lower alkyl fatty acid esters, and extracting said esters with carbon dioxide under supercritical conditons.

2. A process according to claim 1, wherein the esters are methyl esters.

3. A process according to claim 1, wherein lower molecular weight acid esters are extracted to leave a residue.

4. A process according to claim 3, wherein higher molecular weight polyunsaturated acid esters are recovered from the residue.

5. A process according to claim 1, wherein the mixture of lower alkyl fatty acid esters is extracted with successive portions of carbon dioxide.

6. A process according to claim 5, wherein the successive portions of carbon dioxide contain enhanced concentrations of higher molecular weight acid esters.

7. A process according to claim 1 wherein the carbon dioxide is at a pressure of about 2000–3500 psi.

8. A process according to claim 7, wherein the temperature of extraction is between about 24°–80° C.

9. A process according to claim 1, wherein the fish oil is menhaden, Peruvian sardine, sea bass, albacore tuna, skipjack tuna or yellowfin tuna oil.

10. A process according to claim 1, wherein the fish oil contains less than 3% of 20:1 and less than 3% of 22:1 fatty acid glycerides.

11. A process for the concentration of polyunsaturated fatty acids present as their glycerides in a fish oil containing relatively low proportions of saturated and mono-unsaturated fatty acids, also present as their glycerides, of the same chain length as the polyunsaturated fatty acids to be concentrated, consisting essentially of hydrolyzing said glycerides to form a mixture of fatty acids, and extracting said acids with carbon dioxide under supercritical conditions.

12. A process according to claim 11, wherein lower molecular weight acids are extracted to leave a residue.

13. A process according to claim 11, wherein higher molecular weight polyunsaturated acids are recovered from the residue.

14. A process according to claim 11, wherein the mixture of fatty acids is extracted with successive portions of carbon dioxide.

15. A process according to claim 14, wherein the successive portions of carbon dioxide contain enhanced concentrations of higher molecular weight acids.

16. A process according to claim 11, wherein the fish oil is menhaden, Peruvian sardine, sea bass, albacore tuna, skipjack tuna or yellowfin tuna oil.

17. A process according to claim 11, wherein the fish oil contains less than 3% of 20:1 and less than 3% of 22:1 fatty acid glycerides.

18. A process for the concentration of polyunsaturated acids present as their glycerides in a fish oil containing relatively low proportions of saturated and monounsaturated fatty acids, also present as their glycerides, of the same chain length as the polyunsaturated fatty acids to be concentrated, consisting essentially of trasnesterifying said glycerides with a lower alkanol to a form a mixture of lower alkyl fatty acid esters, pretreating said mixture of lower alkyl fatty acid esters to remove unsaturated and mono-unsaturated fatty esters, and extracting said esters with carbon diode under spercritical conditions.

19. A process for the concentration of polyunsaturated fatty acids present as their glycerides in a fish oil containing relatively low proportions of saturated and mono-unsaturated fatty acids, also present as their glycerides, of the same chain length as the polyunsaturated fatty acids to be concentrated, consisting essentially of hydrolyzing said glycerides to form a mixture of fatty acids, pretreating said mixture of fatty acids to remove unsaturated and mono-unsaturated fatty acids, and extracting said acids with carbon diodide under supercritical conditions.

* * * * *